US006969950B2

(12) United States Patent
Breuer et al.

(10) Patent No.: US 6,969,950 B2
(45) Date of Patent: Nov. 29, 2005

(54) SEALING FOIL AND ASSOCIATED LAMP HAVING THIS FOIL

(75) Inventors: Franz Breuer, Ingolstadt (DE); Axel Bunk, Munich (DE); Bodo Mittler, Neusass (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 123 days.

(21) Appl. No.: 10/419,185

(22) Filed: Apr. 21, 2003

(65) Prior Publication Data

US 2003/0201718 A1 Oct. 30, 2003

(30) Foreign Application Priority Data

Apr. 24, 2002 (DE) ..... 102 18 412
Sep. 11, 2002 (DE) ..... 102 42 035

(51) Int. Cl.[7] ..... H01J 61/36; H01J 17/18
(52) U.S. Cl. ..... 313/623; 313/625; 313/332
(58) Field of Search ..... 313/623, 625, 313/626, 318.01, 634, 332, 331

(56) References Cited

U.S. PATENT DOCUMENTS

| | | | | |
|---|---|---|---|---|
| 3,420,944 A | 1/1969 | Holcomb | 313/318.12 |
| 3,793,615 A * | 2/1974 | Homonnay et al. | 439/611 |
| 4,110,657 A | 8/1978 | Sobieski | 313/332 |
| 4,559,278 A * | 12/1985 | Nagy et al. | 428/630 |
| 5,021,711 A | 6/1991 | Madden et al. | 313/623 |
| 6,600,266 B1 * | 7/2003 | Nakagawa | 313/623 |

FOREIGN PATENT DOCUMENTS

| | | | |
|---|---|---|---|
| CA | 1135781 | 2/1979 | H01J 61/36 |
| DE | 199 61 551 | 6/2001 | H01J 61/36 |
| EP | 1047111 A2 * | 10/2000 | H01J 61/86 |
| JP | 2002260581 A * | 9/2002 | H01J 61/20 |

* cited by examiner

*Primary Examiner*—Karabi Guharay
*Assistant Examiner*—Sikha Roy
(74) *Attorney, Agent, or Firm*—William E. Meyer

(57) ABSTRACT

Sealing foil for making a lamp (1), comprising a metallic base body made from molybdenum and a coating which has been applied to at least part of the base body and which contains chromium, rhenium or ruthenium, alone or as an alloy, the foil being formed as a stack comprising two parts (10, 11) which have a different coating.

8 Claims, 2 Drawing Sheets

SEALING FOIL AND ASSOCIATED LAMP HAVING THIS FOIL

TECHNICAL FIELD

The invention relates to a sealing foil and associated lamp having this foil in accordance with the preamble of claim 1. It deals in particular with molybdenum foils which are used in pinches as are customary for sealing incandescent lamps and discharge lamps.

BACKGROUND ART

U.S. Pat. No. 5,021,711 has already disclosed a sealing foil and associated lamp having this foil. To provide better protection against oxidation, the foil is provided with a protective layer of Al, Cr, Si, Ti or Ta. The thickness is 5 to 100 nm.

A similar technique is known from CA -A 1135781, in which layers of Ta, Nb, V, Cr, Ti, Y, La, Hf or Sc are used for the same purpose. The layer thickness is 10 to 200 nm.

In practice, partial chromium-plating is generally used to protect the molybdenum foils from oxidation in the region of the foil-pin welded joint. In this very laborious procedure, the welded joints produced between pin and foil by resistance welding are manually placed into a sand-like medium up to the height to which the chromium plating is to take place. In an environmentally polluting process, the partial deposition of chromium is carried out by chemical reactions. This chromium deposition (oxidation protection) results in an increased ability of the foil-pin joints to withstand high temperatures. A thermal load of up to approx. 550° C. is then possible.

For some lamps, it is not the oxidation of the foil-pin joints which is responsible for the failure of the foil seal, but rather the attack of the corrosive fill constituents (for example metal halides) or filling gases on the molybdenum foil. To limit this attack, the molybdenum foil has hitherto been sand-blasted, which leads to an improvement in the glass-metal joint. However, the sand-blasting leads to high levels of scrap during resistance welding, since it causes nonconductive $Al_2O_3$ particles to remain on the surface of the Mo foil. Moreover, the wear to the resistance welding electrodes is increased very considerably. In the case of sand-blasted foils, it is necessary to replace the electrode after only approx. 70 welds (compared to a replacement interval of approx. 1000 welds for an untreated foil), and consequently a frequent change of the electrodes is required.

DE-A 199 61 551 which corresponds to U.S. Ser. No. 09/705,026 has disclosed the use of Ru containing foils in lampmaking. This document recommends uniform coating of at least one side of the foil.

DISCLOSURE OF THE INVENTION

It is an object of the present invention to provide a sealing foil for lampmaking, comprising a metallic base body made from molybdenum, whether pure or doped, and a coating which is applied to at least part of the base body and which contains chromium or rhenium or ruthenium individually or in combination, said sealing foil is well protected against oxidation and corrosion and in which weldability continues to be ensured, and with these properties being retained even in the event of high thermal loads.

This object is achieved by the features that the foil is built up as a stack comprising two individual foils, the two foils having a common overlap zone within which they are joined to one another. Particularly advantageous configurations are to be found in the dependent claims.

To prevent the oxidation and corrosion and to ensure good weldability, the sealing foil is assembled as a stack comprising two foils. It is preferable for a molybdenum foil to be used for each of the two parts. One or both parts are coated in a specific way with pure ruthenium, rhenium or chromium or a compound or alloy which contains ruthenium, rhenium or chromium. A particularly suitable coating material is pure ruthenium (Ru), rhenium (Re) or chromium (Cr) or a molybdenum-ruthenium alloy with a eutectic composition. The particular advantage of using Ru is that a complicated profile of requirements is satisfied: Ru not only provides a reliable glass-metal joint, so that good bonding between the two components and therefore a good seal are achieved, but also provides a simple joint produced by welding or soldering; furthermore, it is also resistant to halogens and inert with regard to any contact with the fill.

The first foil is specifically designed for reliable welding of the outer supply conductors (typical molybdenum pins) and for reliable protection against oxidation. At least in the region of the joint between supply conductor and foil, it is provided on both sides with a covering which prevents or at least reduces the oxidation and has a layer thickness of at least 800 nm. All three materials are suitable for this foil, but the best results are achieved with ruthenium. The second foil, which is the inner foil with regard to the bulb volume, is designed as a sealing section. It is not coated at all or is provided with a thin coating (<120 nm) on one side, ensuring that the filament ends or inner supply conductors are welded on securely. In particular ruthenium, whether pure or as an alloy, in particular a Mo—Ru alloy, is suitable for this purpose.

The thickness of the layer which consists of at least one of the materials rhenium, chromium or ruthenium is preferably in the range from 1.5 to 3 $\mu$m for the welding foil which is coated on two sides.

The layer thickness for the sealing foil which is coated on one side is in the range of at least 20 nm if the welding foil is coated with Ru. If Cr and/or Re is/are used for the welding foil, the sealing foil may be coating-free or in particular Ru may be used to coat it on one side. It is preferable to use a eutectic Mo—Ru alloy and a layer thickness in the range from 40 to 80 nm for the sealing foil.

The two foils are joined to one another by a weld (in particular a resistance or laser weld).

The use of a single foil (instead of a stack of two foils) with a continuous coating of constant layer thickness has proven to be less expedient, since the specific advantages of a Re—, Cr— or Ru-containing coating cannot then be fully exploited. A variable coating of a single foil has proven equally unsuitable, since the layer thicknesses required for weldability purposes and reliable sealing differ greatly and cannot readily be reconciled. In addition, the first foil, the welding foil, can be welded particularly successfully if Ru is used. It is therefore reliably joined to the second foil, the sealing foil. If Re or Cr is used for the latter, it may be necessary to use a paste to improve the weldability.

The coating can be carried out using known coating processes, preferably by sputtering. Electrodepostion is also suitable in the case of chromium.

In a preferred embodiment, the oxidation resistance of the pin-foil welded joints is increased by coating the supply conductors with the same or similar coating materials which can be used for the foil.

The electric lamps according to the invention have a lamp vessel made from quartz glass or hard glass which is provided with molybdenum foil lead-throughs which are part of at least one pinch seal of the lamp vessel. At least one molybdenum foil is pinched in a gas-tight manner into the at least one pinch seal.

The application of a thin layer of ruthenium (pure or as an alloy) to one side of the second foil makes it possible for extremely fine supply conductors (which may be designed in the form of a coil) to be connected to the foil in a reliable and simple way. Instead of the resistance welding with the aid of a paste (molybdenum or platinum) which has been used hitherto and is only suitable for thick supply conductors or means accepting a very high scrap rate in the case of extremely fine supply conductors, it is now possible to carry out a brazing process (preferably using a eutectic MoRu alloy), for which relatively low temperatures (typically approximately 360° C. less than for pure Ru) are sufficient. Instead of approximately 2300° C., temperatures of only around 1900 to 2000° C. are now reached.

BRIEF DESCRIPTION OF THE DRAWING

The invention is to be explained in more detail below with reference to a plurality of exemplary embodiments. In the drawing.

BEST MODE FOR CARRYING OUT THE INVENTION

Figure 1:
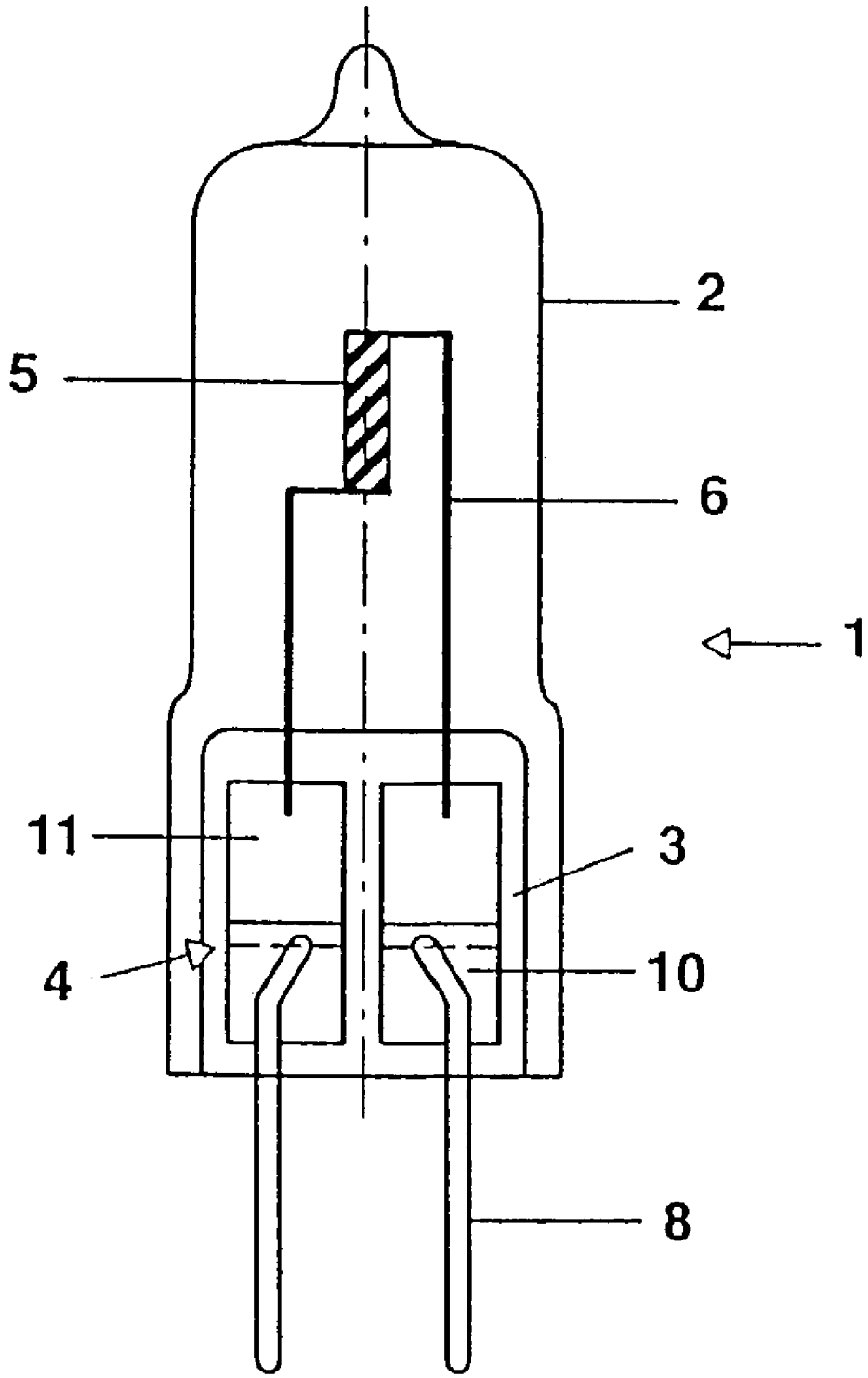
FIG. 1 shows a side view of an incandescent lamp.

The exemplary embodiment shown in FIG. 1 is a halogen incandescent lamp 1 (12V for 100 W output) with a lamp bulb 2 made from quartz glass, which is closed off in a gas-tight manner with the aid of a pinch seal 3. Two molybdenum foil stacks 4 are embedded in the pinch seal of the lamp bulb. Inside the lamp bulb there is a double-coiled luminous body 5, of which the single-coiled ends act as inner supply conductors 6. The inner supply conductors are each welded to a molybdenum foil stack 4 embedded in the pinch seal. Two outer supply conductors 8, which are each connected to one of the two molybdenum foil stacks, project out of the pinch seal 3.

The two molybdenum foil stacks 4 embedded in the pinch seal each comprises two foils 10, 11. The inner sealing foil 11 is coated with a 60 nm thick eutectic Mo—Ru alloy on one side, specifically the side to which the inner supply conductor 6 is secured. The outer welding foil 10 is coated on both sides with pure Ru with a layer thickness of 2.5 $\mu$m. Both foils are of the same width.

In another embodiment, the outer welding foil is coated on both sides with pure Cr or Re with a thickness of 2.5 $\mu$m. The inner sealing foil 11 is either not coated at all or is coated on one side, the side to which the inner supply conductor 6 is secured, with a 60 nm thick eutectic Mo—Ru alloy.

The two foils 10, 11 overlap one another over approx. 10 to 40%, preferably 15 to 30%, of the area of one wide side of the welding foil 10 and are welded together in this region of the stack. The welding foil 10, whose total area may be smaller than that of the sealing foil, rests on the sealing foil 11, which may be larger. An embodiment in which the foils 10, 11 are of the same width is preferred, since this facilitates orientation and alignment of the foils. The overlap between the two foils is indicated in FIG. 1 by the end of the bottom sealing foil 11 illustrated by dashed lines.

The filament end which acts as the inner supply conductor 6 consists of 15 $\mu$m thick tungsten wire which forms a single coil. Its external diameter is 55 $\mu$m. The filament end and the sealing foil 11 are joined to one another by a brazing process.

Even extremely fine supply conductors (only 10 to 100 $\mu$m thick) can be gently and reliably joined to the sealing foil 11 in a similar way. Therefore, ruthenium-coated foils are particularly suitable in particular for low-voltage lamps (up to 75 V) with a high output (20 W to 150 W). However, use for high-voltage lamps (above 80 V) is also recommended.

The differentiated ruthenium coating technique therefore not only allows an improved joint to be produced between foil and supply conductor but also allows a reliable joint to be produced between the two foils of the stack.

Figure 2C:
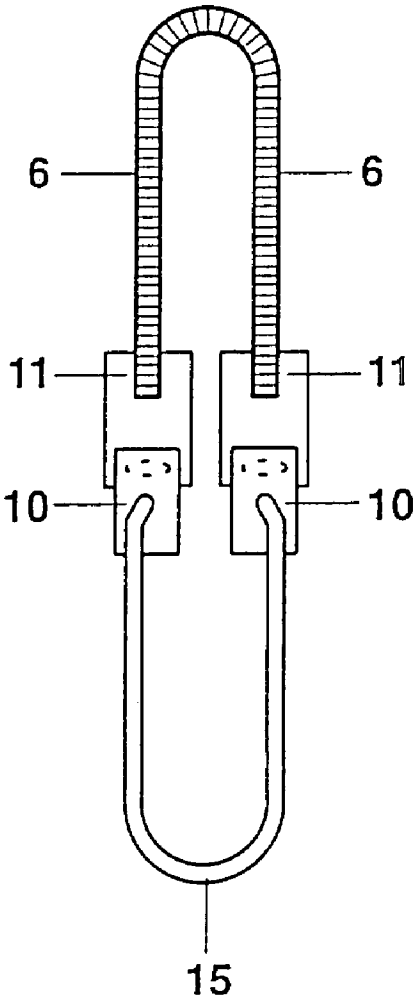
FIG. 2 shows the production of a frame in three steps (a, b, c) in detail.
Figure 2B:
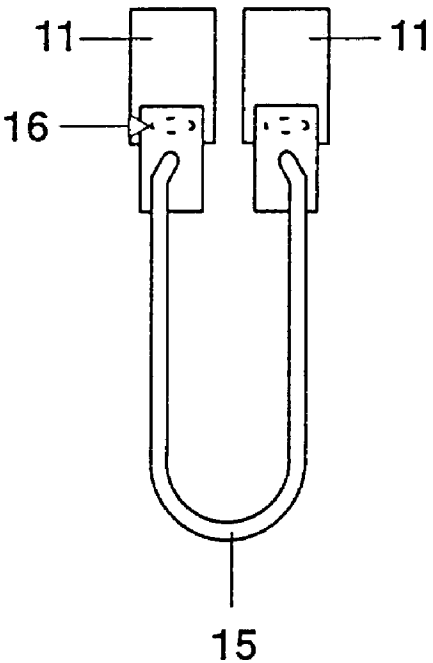
Figure 2A:
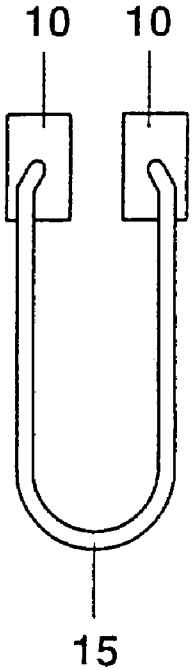

The production of the frame shown in FIG. 2 can take place in such a way that first of all two welding foils 10 (FIG. 2*a*) are welded to a wire bow 15 which is curved in a U shape and is used as the forerunner of the two outer supply conductors. The wire bow 15 is secured to the top side of the welding foils 10 which are coated on both sides. Then, this frame part is placed onto two sealing foils 11 which are coated on one side, specifically with a small overlap amounting to approximately 15% of the surface area of the welding foil 10, the coated sides of the two foils being in contact with one another. The two foils of the stack are of different widths and lengths. The coating is not specifically illustrated. The overlap zone is welded. The welding location is diagrammatically indicated by reference numeral 16 (FIG. 2*b*). Then, a frame part comprising inner supply conductors 6 and luminous body is placed and soldered onto the free end of the welding foils 11 (FIG. 2*c*).

In this context, there is no specific distinction drawn between soldering and welding processes. In the present application, the general term welding is also intended to encompass brazing.

What is claimed is:

1. A lamp foil for forming a lamp seal comprising:

a welding foil for coupling to an outer supply conductor, the welding foil having at least a molybdenum core;

a sealing foil for coupling to an inner supply conductor, the sealing foil having at least a molybdenum core;

the welding foil positioned to partially overlap the sealing foil; and at least a rhenium alloy layer directly intermediate the molybdenum core of the welding foil and the molybdenum core of the sealing foil, the welding foil, rhenium layer and sealing foil being joined together as a conductive unit where the welding foil partially overlaps the sealing foil.

2. The lamp foil in claim 1, wherein the welding foil is coated with at least a rhenium alloy.

3. The lamp foil in claim 1, wherein the at least a rhenium alloy is pure rhenium.

4. The lamp foil in claim 1, wherein the at least a rhenium alloy is an alloy of rhenium and chromium.

5. The lamp foil in claim 1, wherein the at least a rhenium alloy is an alloy of rhenium and ruthenium.

6. The lamp foil in claim 1, wherein the layer thickness is between 0.8 and 4 $\mu$m.

7. The lamp foil in claim 6, wherein the layer thickness is between 2 and 3 $\mu$m.

8. The foil as claimed in claim 1, wherein the overlap is between 10 and 40% of the area of one side of the welding foil.

* * * * *